US007530208B2

(12) United States Patent
Biondi et al.

(10) Patent No.: US 7,530,208 B2
(45) Date of Patent: May 12, 2009

(54) CIGARETTE PACKING MACHINE

(75) Inventors: Andrea Biondi, Bologna (IT); Alessandro Minarelli, Bazzano (IT); Luca Cavazza, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 11/728,579

(22) Filed: Mar. 26, 2007

(65) Prior Publication Data

US 2007/0240388 A1 Oct. 18, 2007

(30) Foreign Application Priority Data

Mar. 29, 2006 (IT) ..... BO2006A0215

(51) Int. Cl.
*B65B 11/06* (2006.01)

(52) U.S. Cl. ..... 53/228; 53/170; 53/202; 53/223; 53/207; 53/173

(58) Field of Classification Search ..... 53/461, 53/170, 173, 202, 207, 223, 228, 230
See application file for complete search history.

(56) References Cited

U.S. PATENT DOCUMENTS

| | | | | |
|---|---|---|---|---|
| 4,084,393 | A | 4/1978 | Focke | |
| 5,216,870 | A * | 6/1993 | Boriani et al. | 53/448 |
| 6,505,732 | B1 * | 1/2003 | Meinke et al. | 198/470.1 |
| 6,694,703 | B1 * | 2/2004 | Grossmann et al. | 53/228 |

FOREIGN PATENT DOCUMENTS

| | | |
|---|---|---|
| EP | 0 315 821 | 5/1989 |

* cited by examiner

*Primary Examiner*—Hemant M Desai
(74) *Attorney, Agent, or Firm*—Ladas & Parry LLP

(57) ABSTRACT

A cigarette packing method and machine, whereby blanks, fed successively along a feed path inside respective feed pockets, are fed to a loading station where each blank is transferred, by a pusher and along a transfer path, to a respective packing pocket fed to the loading station along a packing path, and is folded partly, during transfer along the transfer path, to define a seat for receiving a respective wrapped group of cigarettes, and which is formed by feeding the blank and the pusher through a folding spindle located, at the loading station, between the feed path and the packing path and along the transfer path.

16 Claims, 5 Drawing Sheets

3
27
P2
28
33
20
30
26
31
31
26
33
32
26
31
45
43
42
39
38
45
33
25
1
36
24
35
29
23
P1
2
19
P3
P3
19
26
49
S
22
P3
19
21
22
48
47

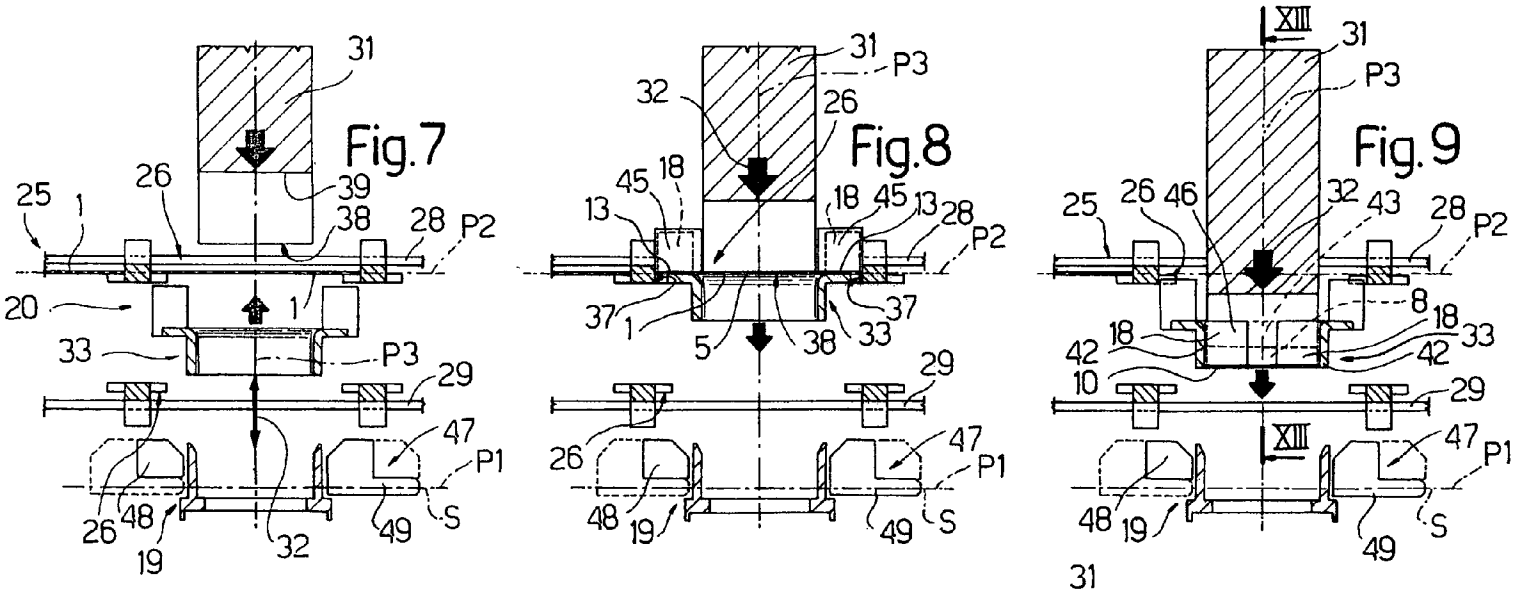
Fig.7
Fig.8
Fig.9
P1
P2
P3
S
XIII
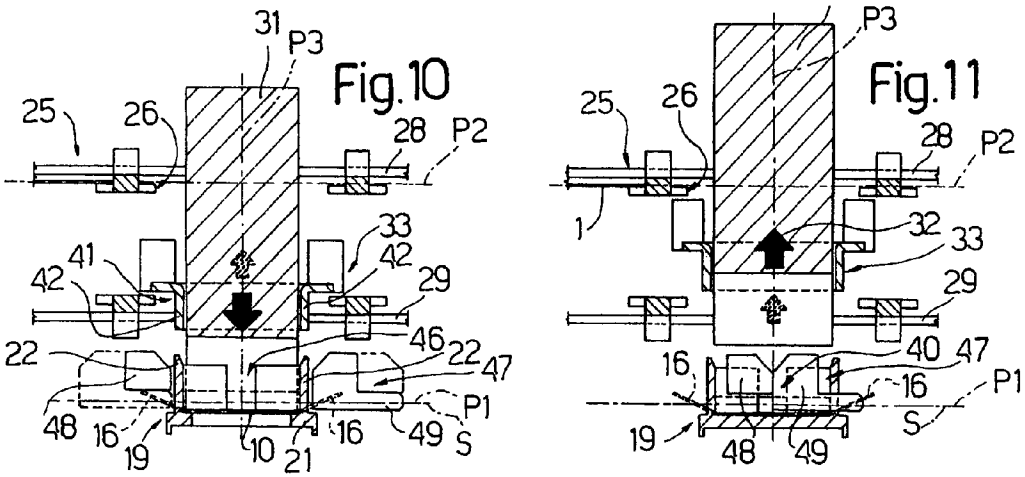
Fig.10
Fig.11
P1
P2
P3
S

CIGARETTE PACKING MACHINE

The present invention relates to a cigarette packing machine and method.

BACKGROUND OF THE INVENTION

More specifically, the present invention relates to a cigarette packing machine of the type comprising a packing conveyor having a number of packing pockets, each of which is designed to receive and house a respective wrapped group of cigarettes and a respective blank, and travels along a packing path extending through a loading station, where the blanks are loaded into the respective packing pockets; a feed unit for feeding the blanks along a feed path through the loading station, and which comprises a feed conveyor travelling along the feed path and having a number of feed pockets, each designed to receive and house a respective blank; and a transfer device located at the loading station and comprising a pusher movable back and forth along a transfer path to transfer the blanks from the respective feed pockets to the respective packing pockets in a given transfer direction. A machine of this type is known, for example, from U.S. Pat. No. 5,052,993.

In known machines of the type described above, the blanks are partly folded by inserting them inside the respective packing pockets.

Normally, and especially when the packing pockets have no movable walls, the above folding method calls for relatively prolonged stops of the packing pockets at the loading station.

SUMMARY OF THE INVENTION

It is an object of the present invention to provide a cigarette packing machine and method designed to reduce the stop time of the packing pockets.

According to the present invention, there are provided a cigarette packing machine and method as claimed in the attached Claims.

BRIEF DESCRIPTION OF THE DRAWINGS

A non-limiting embodiment of the present invention will be described by way of example with reference to the accompanying drawings, in which:

FIGS. 7 to 12 show cross sections of the FIG. 5 machine in respective operating configurations;

DETAILED DESCRIPTION OF THE INVENTION

Figure 2:
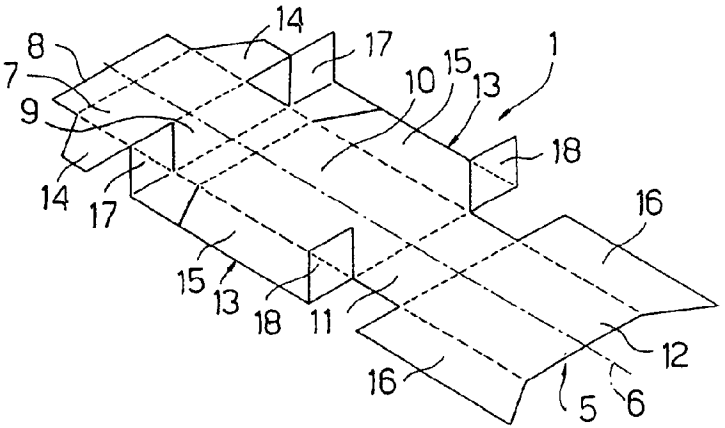
FIGS. 2 to 4 show a folding sequence of the FIG. 1 blank.
Figure 1:
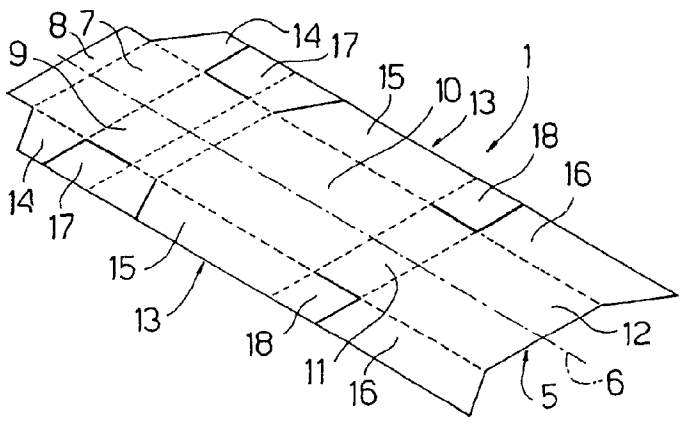
FIG. 1 shows a view in perspective of a blank used on the machine according to the present invention.

Number 1 in FIGS. 1 to 4 indicates a blank, which, as it is fed by a packing wheel 2 (FIG. 5) of a packing machine 3 along a packing path P1, is folded about a respective wrapped group 4 of cigarettes (FIG. 4), i.e. a group of cigarettes wrapped in a normally foil wrapping.

Blank 1, which is known, is substantially rectangular, and comprises a central portion 5 extending along a longitudinal axis 6, and in turn comprising a front lid panel 7 having a reinforcing flap 8; a top lid panel 9; a rear panel 10; a bottom panel 11; and a front panel 12. Blank 1 also comprises two longitudinal lateral wings 13 located on opposite sides of central portion 5, and each comprising a portion 14 extending along front lid panel 7; a portion 15 extending along rear panel 10; a portion 16 extending along front panel 12; a tab 17 extending from portion 15 to portion 14; and a tab 18 extending from portion 15 to portion 16.

Figure 4:
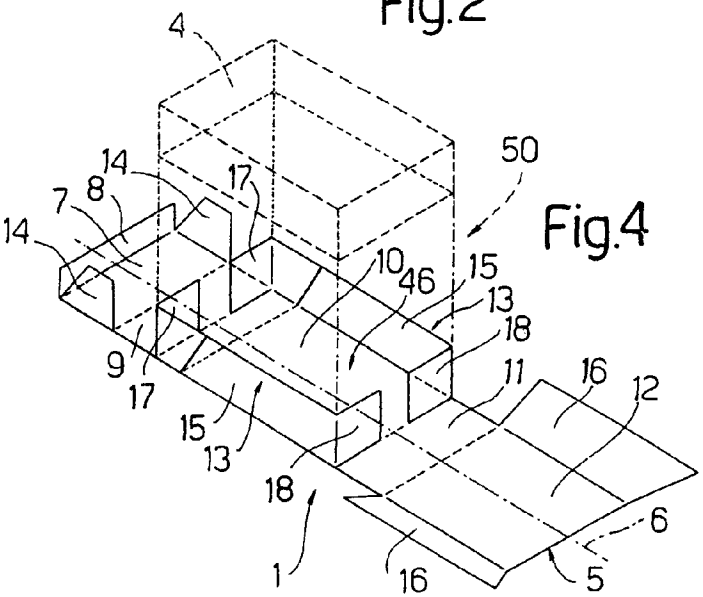
Figure 3:
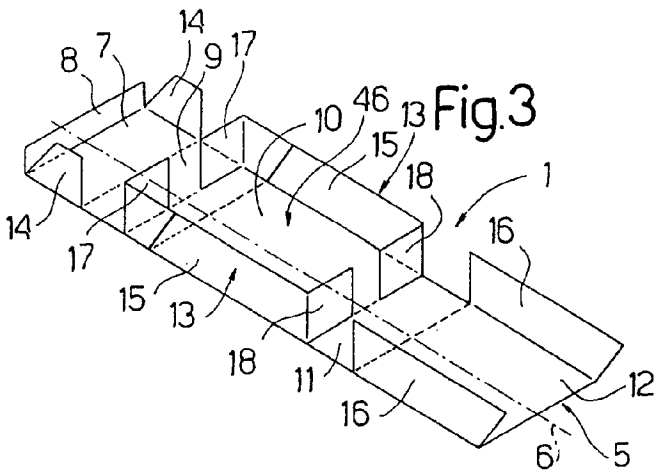
Figure 5:
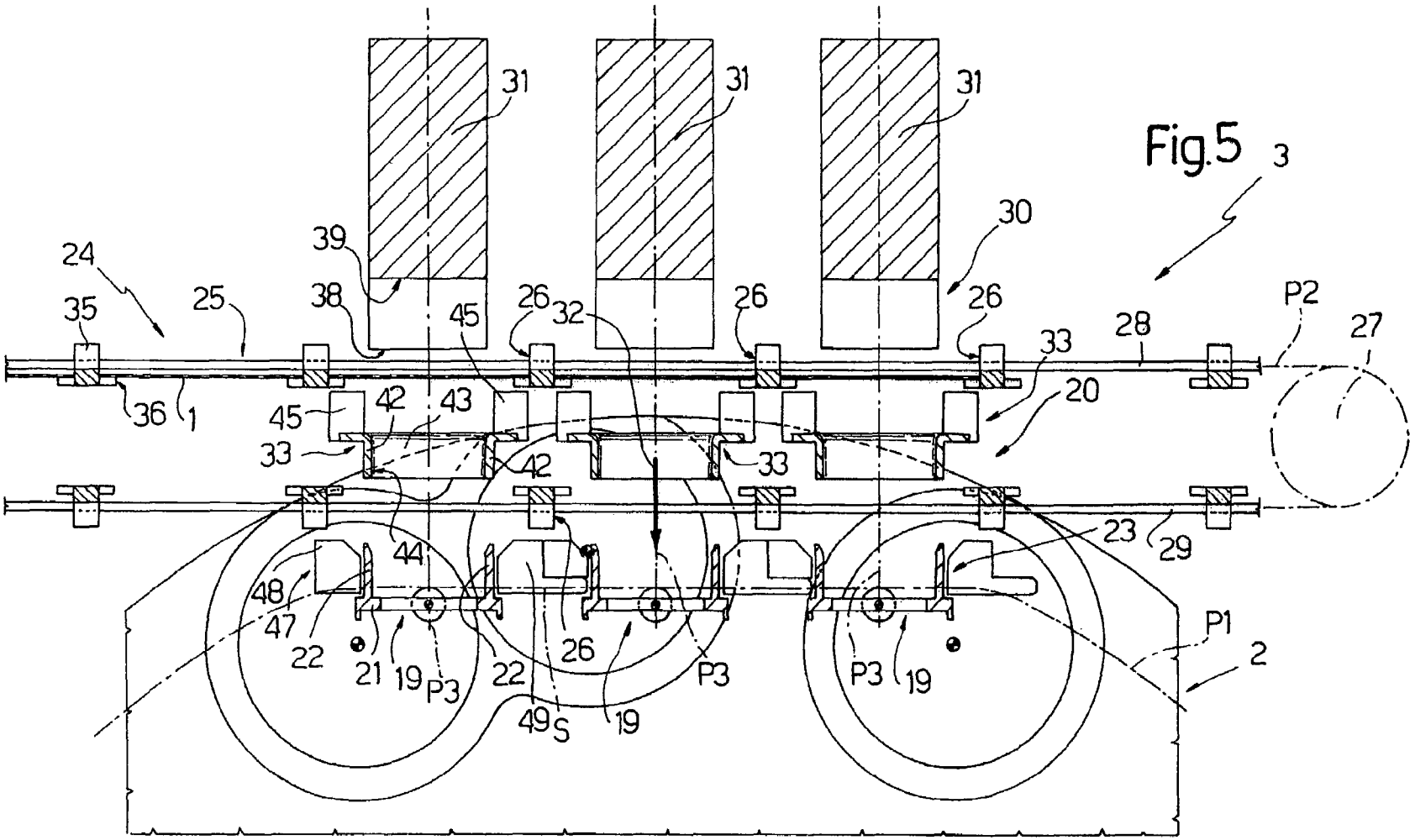
FIG. 5 shows a partial, schematic view, with parts in section and parts removed for clarity, of a preferred embodiment of the machine according to the present invention.

With reference to FIG. 5, packing wheel 2 comprises a number of peripheral packing pockets 19, each of which is designed to receive and house a respective wrapped group 4 of cigarettes (FIG. 4) and a respective blank 1, and is fed in steps along a packing path P1 through a loading station 20, where blanks 1 are loaded into respective packing pockets 19.

Each packing pocket 19 is substantially U-shaped, with its concavity facing outwards of packing wheel 2, and comprises a bottom wall 21 parallel to an axis of rotation (not shown) of packing wheel 2; and two lateral walls 22 perpendicular to bottom wall 21 and also parallel to the axis of rotation (not shown) of packing wheel 2. More specifically, the distance between lateral walls 22 is approximately equal to but no smaller than the width of central portion 5 of blank 1; the length of lateral walls 22 and bottom wall 21 equals the length of rear panel 10 of blank 1; and the height of each lateral wall 22 is greater than the width of a lateral wing 13 of blank 1. Packing pockets 19 may be equally spaced along the periphery of packing wheel 2, so as to reach loading station 20 one at a time. In the example shown, however, packing pockets 19 are formed, along the periphery of packing wheel 2, into equally spaced groups 23 (only one shown) comprising at least two packing pockets 19 (in the example shown, each group comprises three packing pockets 19), and packing wheel 2 is rotated in steps to arrest a whole group 23 at loading station 20 at the end of each step. Packing pockets 19 are mounted movably on packing wheel 2, and are controlled so that, at loading station 20, the packing pockets 19 in each group 23 are aligned and equally spaced, with a given spacing, along a plane S located along packing path P1.

In addition to packing wheel 2, packing machine 3 also comprises a feed unit 24 for feeding blanks 1 along a feed path P2 extending through loading station 20 in a direction parallel to plane S and crosswise to the axis of rotation (not shown) of packing wheel 2. Feed unit 24 comprises a feed conveyor 25, which travels along feed path P2 and has a number of feed pockets 26, each for receiving and housing a respective blank 1. In the event packing pockets 19 are formed into groups 23, as in the example shown, feed conveyor 25 is advanced in steps to feed a number of feed pockets 26 equal to the number of packing pockets 19 in each group 23 into loading station 20 at each step. Moreover, feed pockets 26 are spaced along feed conveyor 25 with the same spacing as packing pockets 19 in said group 23 along plane S, and are arrested at loading station 20 so as to face respective packing pockets 19.

As shown in FIG. 5, feed conveyor 25 is an endless conveyor extending about pulleys 27—only one shown—and comprising a conveying branch 28; and a return branch 29, which, in the example shown, extends through loading station 20, between conveying branch 28 and packing wheel 2. More specifically, pulleys 27 are so arranged that each feed pocket 26 on conveying branch 28, when arrested at loading station 20, is positioned facing a respective feed pocket 26 on return branch 29 and a respective packing pocket 19.

Feed pockets 26 of feed conveyor 25 receive blanks 1 from a group of three hoppers (not shown) located along conveying branch 28, upstream from loading station 20. More specifically, a suction loading device (not shown) withdraws three blanks 1 at a time from the outlets of the three hoppers, and inserts the three blanks 1 into three feed pockets 26.

Packing machine 3 also comprises a transfer device 30 located at loading station 20, and which comprises a pusher 31 movable back and forth along a transfer path P3 to transfer blanks 1 from respective feed pockets 26 to respective packing pockets 19 in a transfer direction 32 perpendicular to feed path P2 and plane S. When packing pockets 19 are supplied in groups 23, as in the example shown, transfer device 30 comprises a number of integral pushers 31 equal to the number of packing pockets 19 in each group 23, and each pusher 31 is positioned facing, in transfer direction 32, a respective packing pocket 19 located in plane S at loading station 20.

Finally, for each stationary packing pocket 19 at loading station 20, packing machine 3 comprises a hollow folding spindle 33, which is located along transfer path P3 at loading station 20, between feed path P2 and the. portion of packing path P1 extending along plane S, is penetrated by pusher 31, and is integral with any other folding spindles 33.

Figure 6:
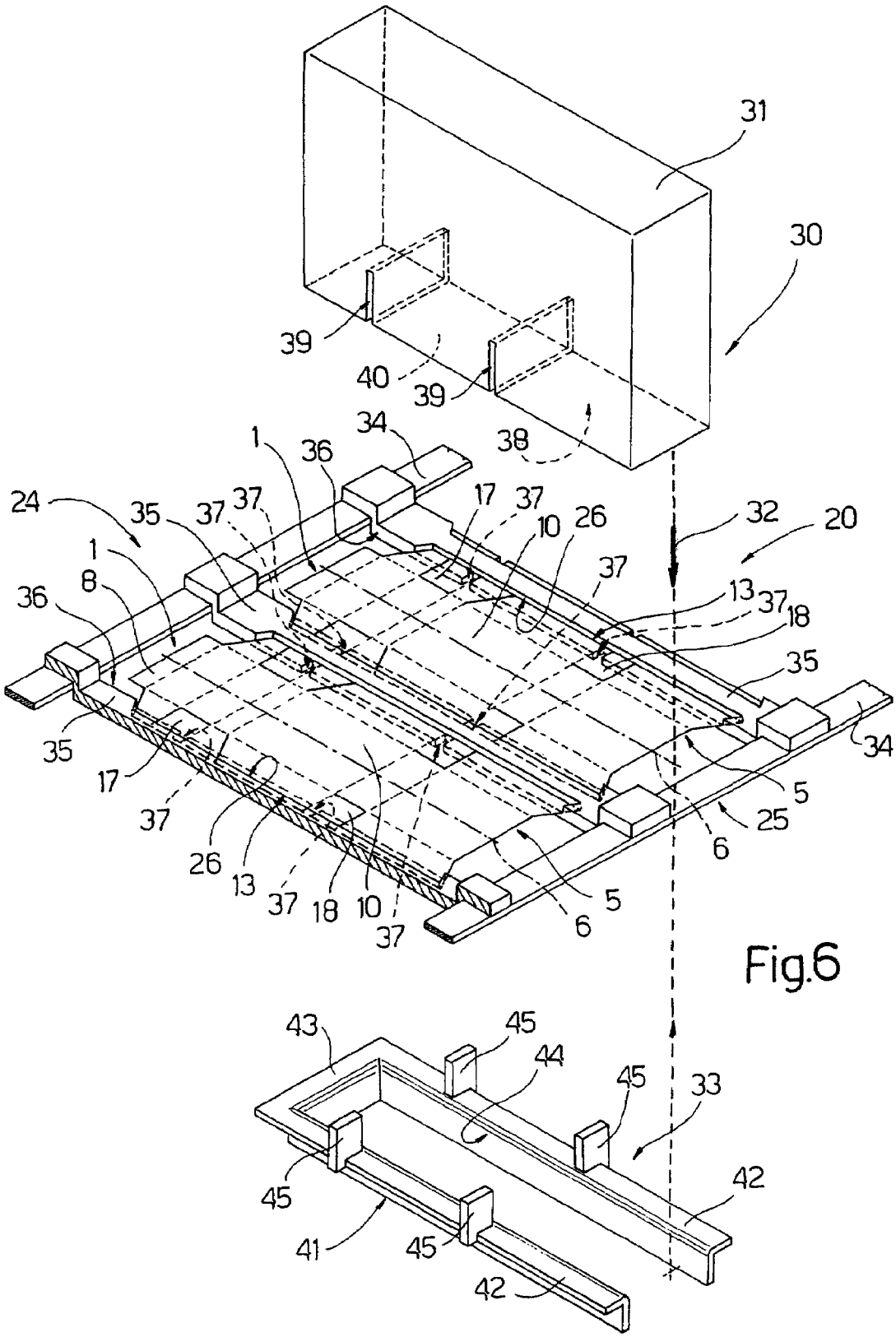
FIG. 6 shows an exploded view in perspective of a detail of FIG. 5.

As shown more clearly in FIG. 6, feed conveyor 25 comprises two flexible belts 34 extending along feed path P2, separated by a distance greater than the length of blanks 1, and connected to each other by a succession of equally spaced cross members 35, each of which defines, with each of the adjacent cross members, a feed pocket 26 having a through opening 36 at, and for the passage of, central portion 5 of relative blank 1. More specifically, each cross member 35 supports a lateral wing 13 of each of the two blanks 1 housed in the two adjacent feed pockets 26, leaving the central portions 5 of the two blanks 1 free. And, along each of its longitudinal lateral edges, each cross member 35 has two slits 37 located close to the base of tab 17 and the base of tab 18 of relative blank 1 respectively.

Still with reference to FIG. 6, each pusher 31 is defined by a parallelepiped-shaped body, a rectangular bottom surface 38 of which is the same length as blank 1 minus respective reinforcing flap 8, is of a width approximately equal to but no larger than the width of central portion 5, and is divided by two transverse slits 39 into three portions, the intermediate portion 40 of which substantially coincides with rear panel 10 of a blank 1 housed inside the feed pocket 26 facing pusher 31. The depth of each slit 39 is greater than the length of tabs 17 and 18.

As shown in FIG. 6, each folding spindle 33 comprises a U-shaped frame 41 defined by two rods 42 parallel to cross members 35 and connected by an end cross member 43. Rods 42 define between them a rectangular passage 44 of substantially the same length and width as bottom surface 38 of relative pusher 31, to permit passage of relative pusher 31 and central portion 5 of relative blank 1 between rods 42. For each rod 42, each folding spindle 33 comprises two folding members 45, each of which is defined by an appendix projecting from frame 41 towards feed path P2 in transfer direction 32, and aligned in transfer direction 32 with a respective slit 37.

As shown in FIGS. 7 to 11, each pusher 31 is movable back and forth, along transfer path P3 and through relative folding spindle 33, between a rest position (FIG. 7), in which each pusher 31 is located on the opposite side of feed path P2 to packing path P1, and a work position (FIG. 10), in which pusher 31 engages a relative packing pocket 19.

As shown in FIGS. 7 to 11, folding spindle 33 is movable in transfer direction 32.

More specifically, from a rest position (FIG. 7), in which each folding spindle 33 is located between feed path P2 and packing path P3, each folding spindle 33 is movable back and forth, along transfer path P3, between an interference position (FIG. 8) interfering with the feed path, and a stop position (FIG. 10) substantially tangent to packing path P1.

Operation of packing machine 1 will now be described with reference to FIGS. 7 to 12, considering one packing pocket 19, relative feed pocket 26, relative pusher 31, and relative folding spindle 33, and as of a start instant (FIG. 7), in which packing pocket 19 is located in plane S at loading station 20, and is positioned, in transfer direction 32, facing an empty feed pocket 26 on return branch 29 of feed conveyor 25, relative folding spindle 33 stationary in the rest position, a feed pocket 26 located on conveying branch 28 of feed conveyor 25 and supporting relative blank 1, and relative pusher 31 stationary in the rest position.

In connection with the above, it should be pointed out that the start configuration shown in FIG. 7 is simplified in the sense that, because of folding spindle 33, arrival of packing pocket 19 at loading station 20 is delayed with respect to that of relative feed pocket 26, and feed pocket 26 and packing pocket 19 are actually only aligned just before reaching the work configuration shown in FIG. 10.

To begin with, folding spindle 33 (FIG. 8) is moved towards pusher 31 into the interference position, and pusher 31 is moved in the opposite direction to folding spindle 33 to bring bottom surface 38 into contact with central portion 5 of blank 1. As folding spindle 33 moves into the interference position with feed path P2, folding members 45 engage slits 37 to fold tabs 17 (not shown in FIG. 8) and tabs 18 squarely with respect to respective lateral wings 13 into the position shown in FIG. 2. During this first folding operation, blank 1 is held firmly inside relative feed pocket 26 by pusher 31.

Figure 13:
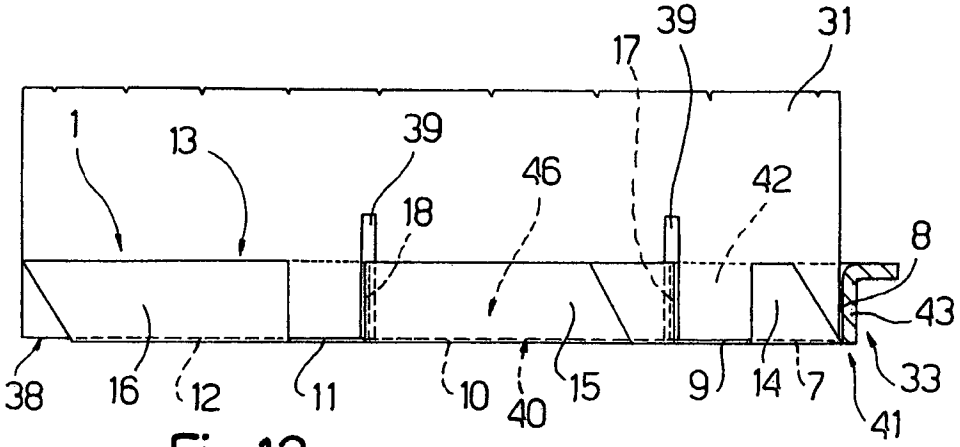
FIG. 13 shows a section along line XIII-XIII in FIG. 9.

Next (FIG. 9), both pusher 31 and folding spindle 33 are moved in transfer direction 32 towards packing path P1, but at different speeds. More specifically, pusher 31 moves faster than folding spindle 33, and so penetrates folding spindle 33, so that reinforcing flap 8 (FIG. 13) is folded squarely with respect to front lid panel 7 by interference with cross member 43, and, at the same time, lateral wings 13 are folded squarely with respect to central portion 5, by lateral wings 13 interfering with rods 42 of folding spindle 33, so that blank 1 assumes the partly folded configuration shown in FIG. 3. As they are folded squarely, lateral wings 13 take along the previously folded tabs 17 and 18, which freely engage respective slits 39 in pusher 31 (FIG. 13).

In this partly folded configuration, blank 1 defines a cup-shaped seat 46—bounded by rear panel 10, tabs 17 and 18, and portion 15 of each lateral wing 13—for later receiving a respective wrapped group 4 of cigarettes (FIG. 4).

As shown in FIG. 10, on reaching the stop position close to packing path P1, folding spindle 33 is arrested, whereas pusher 31 keeps moving to expel the partly folded blank 1 from folding spindle 33 and insert seat 46 inside relative packing pocket 19, with rear panel 10 contacting bottom wall 21 of packing pocket 19.

In connection with the above, it should be pointed out that the width of lateral wings 13 is less than the distance between bottom wall 21 of packing pocket 19 and frame 41 of folding spindle 33 in the stop position, but is greater than the distance between the free edges of lateral walls 22 of packing pocket 19 and frame 41 of folding spindle 33 in the stop position, so that portions 15 (FIG. 3) of lateral wings 13 are maintained in the folded position at all times, first by rods 42 of frame 41, then jointly by rods 42 and lateral walls 22, and finally by lateral walls 22 only. Conversely, portions 16 of lateral wings 13, previously folded squarely by interference with rods 42, are released when blank 1 is expelled from folding spindle 33, and, not being engaged by packing pocket 19, spring back into a partly outward-folded position (FIGS. 4 and 10).

In other words, folding spindle 33 not only provides for forming seat 46 off packing wheel 2 and, in fact, before packing wheel 2 has stopped—thus reducing the downtime of packing wheel 2—but also for precreasing both portions 16 of lateral wings 13, and reinforcing flap 8.

With reference to FIG. 11, once seat 46 is fully inserted inside relative packing pocket 19, folding spindle 33 and pusher 31 are withdrawn from packing path P1 into their respective rest positions shown in FIG. 7.

Figure 12:
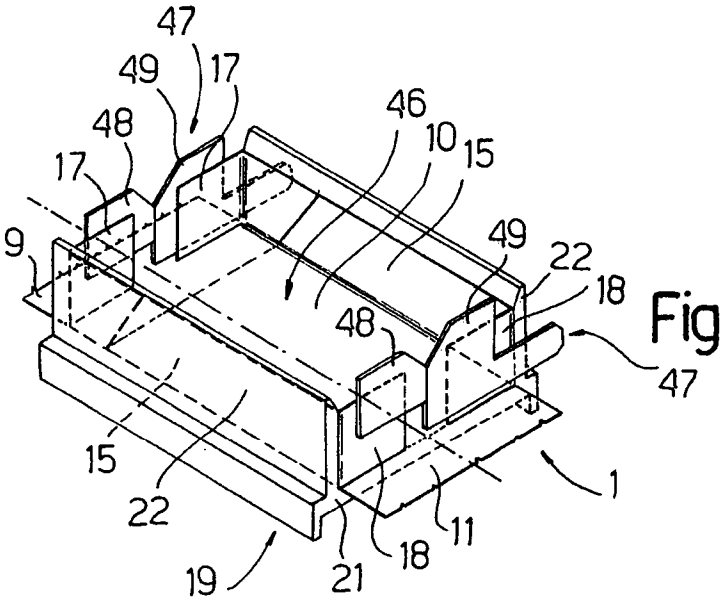

As shown in FIGS. 10 to 12, when stationary at loading station 20, packing pocket 19 is associated with two retaining devices 47, which are located at the open lateral ends of packing pocket 19 at loading station 20, on opposite sides of packing path P1, and provide for holding tabs 17 and 18 in the folded position when seat 46 is housed inside packing pocket 19. Each retaining device 47 comprises two folding members 48, 49, which are movable, in opposite directions and parallel to packing path P1, between an open position (FIG. 10)—assumed by folding members 48, 49 as blank 1 is inserted inside packing pocket 19, to allow passage of top lid panel 9 or bottom panel 11—and a closed position (FIGS. 11 and 12)—assumed by folding members 48, 49 as blank 1 is released inside packing pocket 19, to hold relative tabs 17, 18 in the folded position.

As packing pocket 19 is fed by packing wheel 2 out of loading station 20, the function of retaining devices 47 is taken over by fixed retaining walls (not shown) extending along packing path P1 up to a further loading station 50 (FIG. 4) where a wrapped group 4 of cigarettes is inserted inside packing pocket 19 and relative seat 46.

In an alternative embodiment not shown, feed unit 24 has no feed conveyor 25, and the three hoppers are located directly at loading station 20.

The invention claimed is:

1. A cigarette packing machine comprising:

a packing conveyor having a number of packing pockets, each of which receives and houses a respective wrapped group of cigarettes and a respective blank, and is movable along a packing path extending through a loading station where the blanks are loaded inside the relative packing pockets;

a feed unit for feeding the blanks to the loading station;

a transfer device located at the loading station and comprising a pusher movable back and forth along a transfer path to transfer the blanks from the feed unit to the relative packing pockets in a given transfer direction; and at least one hollow folding spindle, which is located at the loading station, between the feed unit and the packing path and along the transfer path, is movable in the transfer direction along the transfer path, and is penetrated by the pusher to fold the blank.

2. The machine as claimed in claim 1, wherein the folding spindle is movable along the transfer path from a rest position, in which the folding spindle is located between the feed unit and the packing path.

3. The machine as claimed in claim 1, wherein the folding spindle is movable, in the transfer direction, to and from a position of substantial tangency with the packing path.

4. The machine as claimed in claim 1, wherein the folding spindle is movable with the pusher, in the transfer direction, to and from a position of substantial tangency with the packing path.

5. The machine as claimed in claim 1, wherein the feed unit feeds the blanks along a feed path extending through the loading station, and comprises a feed conveyor movable along the feed path and having a number of feed pockets, each for receiving and housing a relative blank.

6. The machine as claimed in claim 5, wherein the folding spindle is movable, in the transfer direction, to and from a position of interference with the feed path.

7. The machine as claimed in claim 5, wherein the pusher is movable, along the transfer path and towards the packing path, from a position in which the pusher is located on the opposite side of the feed path with respect to the packing path, into a work position in which the pusher engages a relative packing pocket(19).

8. The machine as claimed in claim 5, wherein the folding spindle is movable towards the pusher and into a position of interference with the feed path to perform a first folding operation on a relative blank located along the feed path; and is movable with the pusher, but at a first speed slower than a second speed of the pusher, to perform a second folding operation on the relative blank along the transfer path.

9. The machine as claimed in claim 5, wherein the feed conveyor comprises two flexible belts supporting the feed pockets on opposite sides.

10. The machine as claimed in claim 5, wherein: the packing conveyor is moved in steps to feed to, and arrest in, the loading station a group of packing pockets; the feed conveyor is moved in steps to feed to, and arrest in, the loading station an equal number of feed pockets, each of which is positioned, at the loading station, facing a respective packing pocket in the group; and each pair of facing packing and feed pockets is associated with a relative pusher and a relative folding spindle.

11. The machine as claimed in claim 10, wherein the packing pockets in each group are aligned, at the loading station, along the packing path and along a plane parallel to the feed path.

12. The machine as claimed in claim 11 wherein the pushers are integral with one another.

13. The machine as claimed in claim 11 wherein the folding spindles are integral with one another.

14. The machine as claimed in claim 1, wherein the folding spindle comprises a frame having a central passage for the pusher and for a central portion of a relative blank, the frame cooperating with the pusher to fold squarely, with respect to the central portion, two lateral wings of the blank, which are located on opposite sides of the central portion, and each comprise two end tabs; and folding members, each of which projects from the frame in the transfer direction and on the opposite side to the packing path, and engages a respective end tab to fold the end tab squarely with respect to the relative lateral wing.

15. The machine as claimed in claim 1, wherein each feed pocket houses a relative blank by supporting the blank solely by lateral wings of the blank, and leaving a central portion of the blank free, and has a through opening located at the central portion of the blank and permitting passage of the central portion and of the pusher.

16. The machine as claimed in claim 1, wherein, at the loading station, at least one feed pocket of the feed conveyor is aligned with a relative packing pocket in the transfer direction.

* * * * *